US010262488B1

(12) United States Patent
Frank et al.

(10) Patent No.: US 10,262,488 B1
(45) Date of Patent: Apr. 16, 2019

(54) COMPACT CURRENCY RECYCLING AND ACCOUNTING DEVICE AND METHOD OF USE

(71) Applicant: Revolution Retail Systems, LLC, Carrollton, TX (US)

(72) Inventors: David Scott Frank, Coppell, TX (US); Mark K. Levenick, Flower Mound, TX (US)

(73) Assignee: Revolution Retail Systems, LLC, Carrollton, TX (US)

( * ) Notice: Subject to any disclaimer, the term of this patent is extended or adjusted under 35 U.S.C. 154(b) by 0 days.

(21) Appl. No.: 15/784,274

(22) Filed: Oct. 16, 2017

(51) Int. Cl.

| | |
|---|---|
| ***G07D 11/00*** | (2006.01) |
| ***G07D 7/00*** | (2016.01) |
| ***G07D 3/00*** | (2006.01) |
| ***G07D 11/50*** | (2019.01) |
| *G07F 19/00* | (2006.01) |

(52) U.S. Cl.
CPC ..... *G07D 7/00* (2013.01); *G07D 3/00* (2013.01); *G07D 11/50* (2019.01); *G07F 19/00* (2013.01)

(58) Field of Classification Search
CPC .. G07D 3/00; G07D 9/00; G07D 9/02; G07D 11/00; G07D 11/0003; G07D 11/0081; G07D 11/0084; G07D 13/00; G07F 19/00
See application file for complete search history.

(56) References Cited

U.S. PATENT DOCUMENTS 5,644,119 A * 7/1997 Padula ..... G07F 19/20 235/383
5,813,510 A 9/1998 Rademacher
6,003,652 A * 12/1999 Murata ..... G07D 1/00 194/206
6,021,883 A 2/2000 Casanova et al.
7,625,272 B1 * 12/2009 Moreland ..... G07D 3/14 141/358
2003/0190882 A1 10/2003 Blake et al.
(Continued)

FOREIGN PATENT DOCUMENTS

WO 99/021141 A1 4/1999

OTHER PUBLICATIONS

PCT International Search Report and Written Opinion dated Jan. 28, 2019, issued during the prosecution of PCT International Patent Application No. PCT/US2018/056095 (13 pages).

*Primary Examiner* — Mark J Beauchaine
(74) *Attorney, Agent, or Firm* — Locke Lord LLP; Charles E. Phipps; Alicia J. Carroll

(57) ABSTRACT

The present invention relates generally to a compact currency recycling and accounting device and system for use wherein the device can fit under a counter and is capable of receiving, sorting and dispensing both bills and mixed denomination coins. The present invention offers the currency recycling functionality of larger safes in a more compact safe capable of fitting under the counter of a convenience store. The compact currency recycler of the present invention includes a coin recycling unit, a banknote recycling unit, a touchscreen display, a power supply, a CPU and an integrated printer. To overcome the challenges of limited access to only the front of the device in these under counter applications, the device relies upon a sliding, coin-receiving tray and sliding touchscreen display. Additionally, the banknote recycler and the coin recycler are able to slide into and out from the front of the device for ease of access.

16 Claims, 8 Drawing Sheets

(56) References Cited

U.S. PATENT DOCUMENTS

| | | | | |
|---|---|---|---|---|
| 2004/0097182 | A1* | 5/2004 | Hill | G07D 9/00 453/3 |
| 2010/0230231 | A1* | 9/2010 | Uesaka | G07D 9/02 194/206 |
| 2016/0284151 | A1* | 9/2016 | Fujimura | G07D 1/04 |

* cited by examiner

COMPACT CURRENCY RECYCLING AND ACCOUNTING DEVICE AND METHOD OF USE

BACKGROUND OF THE INVENTION

1. Field of the Invention

The present invention relates generally to a compact currency recycling and accounting device and method for use. More specifically, the invention relates to a compact smart safe that can fit under a counter (e.g., in a convenience store) and is capable of receiving, sorting and dispensing both bills and mixed denomination coins.

2. Description of Related Art

Smart safes are currently used in convenience stores, and due to the limited space, these safes typically reside under the counter. These convenience store smart safes are stored under the counter and not accessible from the top. Moreover, they are usually abutted on the sides by other items, they can be accessed only from the front. The smart safes are used to both dispense and receive banknotes and coins. Dispensing of currency and coins from the safes is limited by the operators as to amount and time so as to deter theft. In the event of a robbery, neither the store employees, nor a thief, can operate the smart safe in a manner to expedite dispensing. Typically, these safes include bill validators that can receive, count and validate banknotes before storing them in a cassette. Currency and coins are dispensed from these safes using dispensable vending tubes, which are pre-loaded in fixed amounts.

Existing larger safes are not constrained by the space, height and size limitations of under the counter safes. Existing larger safes are accessible from the top and have increased functionality and operate as true currency recycling systems as compared to existing smart safes used under the counter in convenience stores. These existing larger safes include banknote recyclers and coin recyclers that are operated via a computer and an associated software application which controls the recyclers and guides users through the safe's operations via on-screen instructions. These larger safes prevent cashiers or cash managers from having to manually count cash register bills and coins at the beginning or end of a shift.

Banknote recyclers are typically used in retail, banking, automated teller machines and other cash-based operations where banknotes of various denominations are validated, counted and sorted for subsequent use. For example, a retail or banking cashier at the beginning of a shift requires an amount of bills in various denominations to use in a cash till drawer for dispensing change to customers. A typical banknote recycler has provisions for accepting banknotes of mixed denomination and then separating, validating, counting and sorting the banknotes. The accepted notes of each denomination are then placed into various recycling cassettes configured to receive that specific denomination. These recycling cassettes are capable of dispensing stored notes for use by the store in its operation, which is why they are called recycling cassettes. Low-quality notes and notes of denominations with no recycler cassette configured to accept that denomination are placed into one or more deposit cassettes, where they remain until picked up by a cash-in-transit courier or by the responsible party of the recycler who removes the bills for deposit. The banknote recyclers also have the capability to move notes from the recycling cassettes to the deposit cassette to raise the content of the deposit cassette to the desired monetary value for subsequent retrieval by the cash-in-transit courier. Typically, operators of banknote recyclers do not have the ability to remove notes once they have been placed inside the deposit cassette, as the deposit cassette is locked in place by the cash-in transit courier or the responsible party in the bank or retail environment.

Existing larger safes employ coin recyclers mounted on the top of the safe. Coin recyclers used to fill cash till drawers, like the one disclosed in U.S. Pat. No. 7,625,272, are capable of receiving a batch of mixed denomination coins, sorting the coins into their denominations and dispensing the desired amount of each denomination into that denomination's proper coin receptacle in the cash till drawer or into a coin change cup. The devices are comprised of a coin input area for receiving the batch of mixed denomination coins, a coin sorter having a base, where the coin sorter is capable of validating, counting and sorting a batch of mixed denomination coins. Also included is a first manifold for receiving the sorted coins and directing them into the appropriate coin hoppers, coin hoppers capable of storing coins of a particular denomination and dispensing a desired number of coins on demand, and a second manifold for receiving the coins dispensed from the coin hoppers and directing them into the appropriate compartment in the cash till drawer (or coin change cup), which fits into a housing below the second manifold. Coin recyclers rely upon gravity to move the coins from the top of the safe into the coin sorter, through the first manifold and into the segregated coin hoppers. Further, gravity is used to move the coins after they are dispensed from the coin hoppers into the second manifold and ultimately into the cash till drawer receptacles or coin change cups in the bottom of the safe. These large safes lack the physical constraints of the minimum vertical distance available to under the counter safes.

It is therefore desirable to have a smart safe suitable for use in under the counter locations, such as convenience stores, that affords the functionality currently available only on larger safes including the ability to reduce employee time required to count currency.

SUMMARY OF THE INVENTION

The present invention affords the currency recycling functionality of a larger safe in a more compact safe capable of fitting under the counter of a convenience store. In order to provide a compact safe that operates equivalently to a larger currency recycling safe, several engineering challenges were presented due to the limited space available under a counter and the limited access to only the front of the safe. To overcome the challenge of less vertical space available under the counter and because coin denominations must be handled using gravity, the current device includes novel coin travel paths that are angled and stair-stepped to create a compact flow path. Because of the limited access to only the front of the device in under the counter applications, a forward sliding, coin-receiving tray is used to allow the loading of mixed denomination coins to the front of the device. Further, the banknote recycler and the coin recyclers are able to slide into and out from the front of the device for ease of access. Additionally, the touchscreen display is also mounted on a forward sliding tray to allow it to be pulled forward out from under the counter for access from the front and entry of commands by the user.

The compact currency recycler of the present invention includes a coin recycling unit, a banknote recycling unit, a touchscreen display, a power supply, a CPU and an integrated printer. The front doors of the currency recycler include interlocking hinges that afford crumple zones to deter tampering. If a lever is used in an attempt to remove the doors, the teeth will crumple, allowing buckling but increasing the difficulty of removing the door. The currency recycler can be linked to other devices to communicate status and usage information, and additional units can be appended to the recycler. In use, the compact currency recycler can be bolted to the floor to prevent theft.

The banknote recycler of the compact currency recycler of the present invention has the capability to accept banknotes of mixed denomination and then separate, validate, count and sort the banknotes. The accepted notes of a denomination are placed into at least one recycling cassette configured to receive that specific denomination that are capable of later dispensing these stored notes. Notes of denominations with no recycling cassette configured to accept that denomination (typically larger bills) are placed into one or more of the banknote recycler's deposit cassettes, where they remain until picked up by a cash-in-transit courier or by the responsible party of the recycler who removes the bills for deposit. The banknote recycler also has a load or refill cassette, which is filled manually by the operator and houses one denomination. Banknotes from the refill cassette are used to refill the recycling cassette if the recycling cassette has dispensed all of its banknotes.

The coin recycling unit of the compact currency recycler includes a coin-receiving tray, a coin reject slot, and a coin transport tray. The coin recycling unit is capable of receiving a batch of mixed denomination coins, sorting the mixed denomination coins into a plurality of sorted denomination coins and dispensing the sorted denomination coins. A first set of manifolds receive the sorted denomination coins from the coin sorter and direct the coins to a plurality of coin hoppers to store the sorted denomination coins. The coin hoppers each store one sorted denomination of coin and are operable to dispense the stored coins. A second set of manifolds connects the coin hoppers to a coin transport tray.

In use, the coin-receiving tray slides horizontally out from the front of the device to receive bulk, unsorted coins, which allows the coins to be placed into the tray from the front of the device as there is no way to load coins directly from the top due to the countertop. The coin receiving tray has a front portion with an optional perforated coin-receiving surface hinged on one end. The coin receiving surface can be rotated upward to load the coins into the coin sorter. Once the coin sorter has separated the coins into denominations, the coins enter the upper manifold, which is connected directly to the coin sorter output rather than base of the coin sorter as in existing larger, prior art coin recyclers. This modification was necessary to gain more vertical travel due to the under the counter size constraints and the necessity of using gravity in the coin sorting operation.

A user of the compact currency recycler interfaces with the device through the touchscreen display. A user identification PIN code can be entered. The safe can account for each user's activity with the safe including counting the amount of currency, both bills and coins, that have been inserted into the safe or dispensed from the safe. The safe can be set to monitor each employee or a specific cash drawer till used by multiple employees during a shift. The compact currency recycler therefore affords increased functionality and individual accountability while increasing the speed of processing by eliminating the time and effort required to manually count coins and banknotes. This automated accounting increases operator and manager accountability and can reduce losses.

The novel features and construction of the present invention, as well as additional objects thereof, will be understood more fully from the following description when read in connection with the accompanying drawings.

BRIEF DESCRIPTION OF THE DRAWINGS

The invention is further described and explained in relation to the following figures of the drawings wherein.

Like reference numerals are used to describe like parts in all figures of the drawings.

DESCRIPTION OF THE PREFERRED EMBODIMENTS

Figure 1:
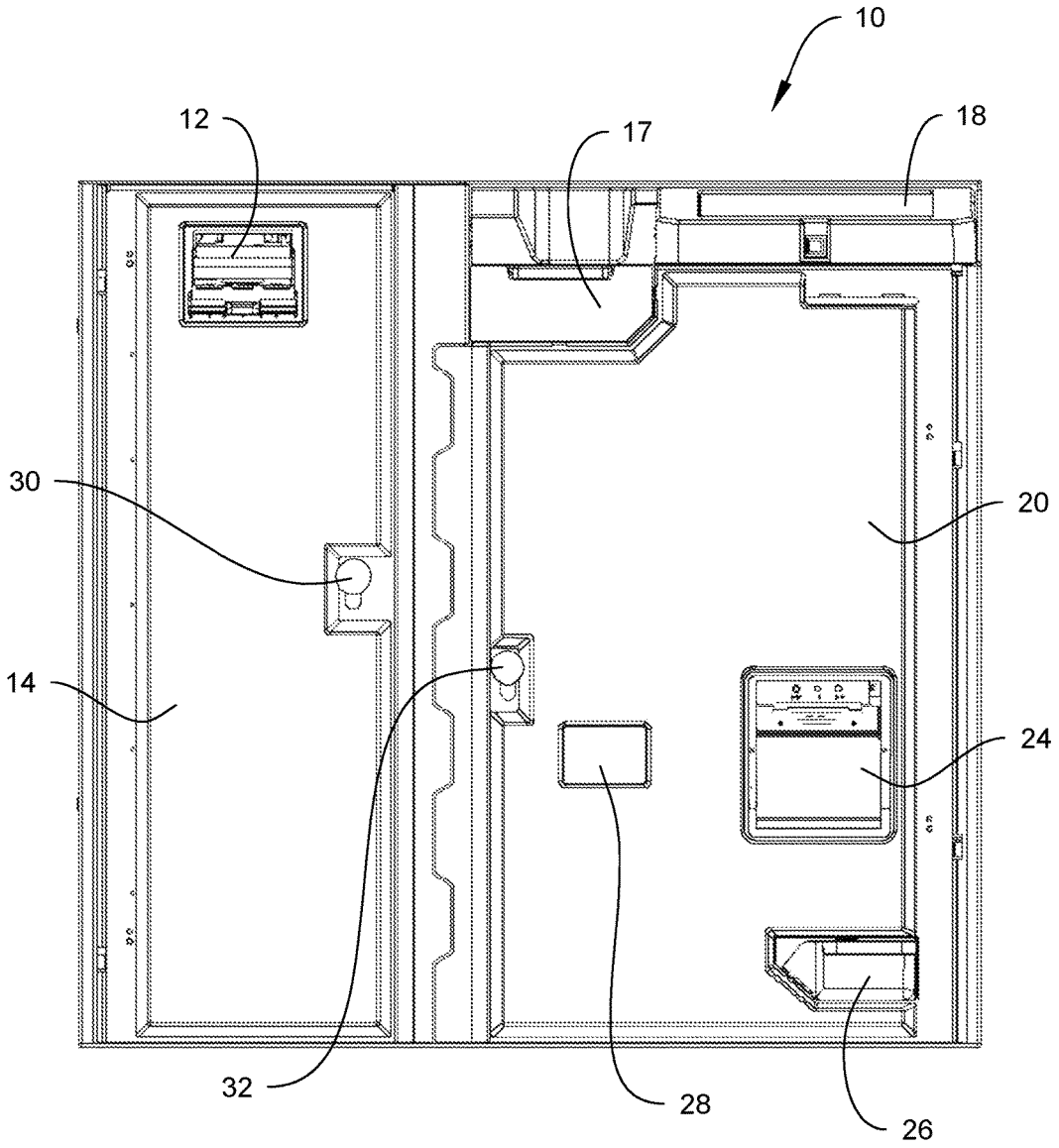
FIG. 1 is a front view of the compact currency recycling and accounting device.

Referring to FIG. 1, compact currency recycling device 10 is shown. Compact currency recycling device 10 houses both a coin recycler and a banknote recycler. Compact currency recycling device 10 is controlled by a computer running a set of software programs that operate the individual components of device 10, including coin recycler and banknote recycler. In addition to housing the recyclers, device 10 also houses touchscreen display 18, a power supply (not shown), a CPU (not shown) and integrated printer 24. Front access doors 14 and 20 close with interlocking hinges that afford crumple zones to deter tampering. If a lever is used in an attempt to remove doors 14 and 20, the interlocking teeth will crumple and buckle, which increases the difficulty of removing doors 14 and 20.

Door 20 closes the side of compact currency recycling device 10 that houses the coin recycler. Door 20 is unlocked either at a specified time or by a command entered by an authorized user on touchscreen display 18, which causes an internal deadbolt to be disengaged. Once the deadbolt is disengaged, door 20 is opened by the user physically lifting handle 32. Door 20 is shaped to accommodate and not interfere with coin receiving tray 17 and touchscreen display 18, which both slide out independently of each other when in use as discussed below. Door 20 houses integrated printer 24, which is built into door 20. Coin reject slot 28 is located in door 20, which is where rejected coins and other non-coin items placed into the coin recycler arrive after being rejected by the coin recycler. Coin transport tray 26, which receives dispensed coins from the coin recycler, fits through an opening near the bottom of door 20.

Similar to door 20, door 14 closes the side of compact currency recycling device 10 that houses the banknote recycler. Door 14 is unlocked either at a specified time or by a command entered by an authorized user on touchscreen display 18 and opened via handle 30, which causes an internal deadbolt to be disengaged. Once the deadbolt is disengaged, door 14 is opened by the user physically lifting handle 30. Door 14 houses banknote validator 12, which accepts bills of various denominations before placing them in the desired cassettes housed inside compact currency recycling device 10.

Figure 2:
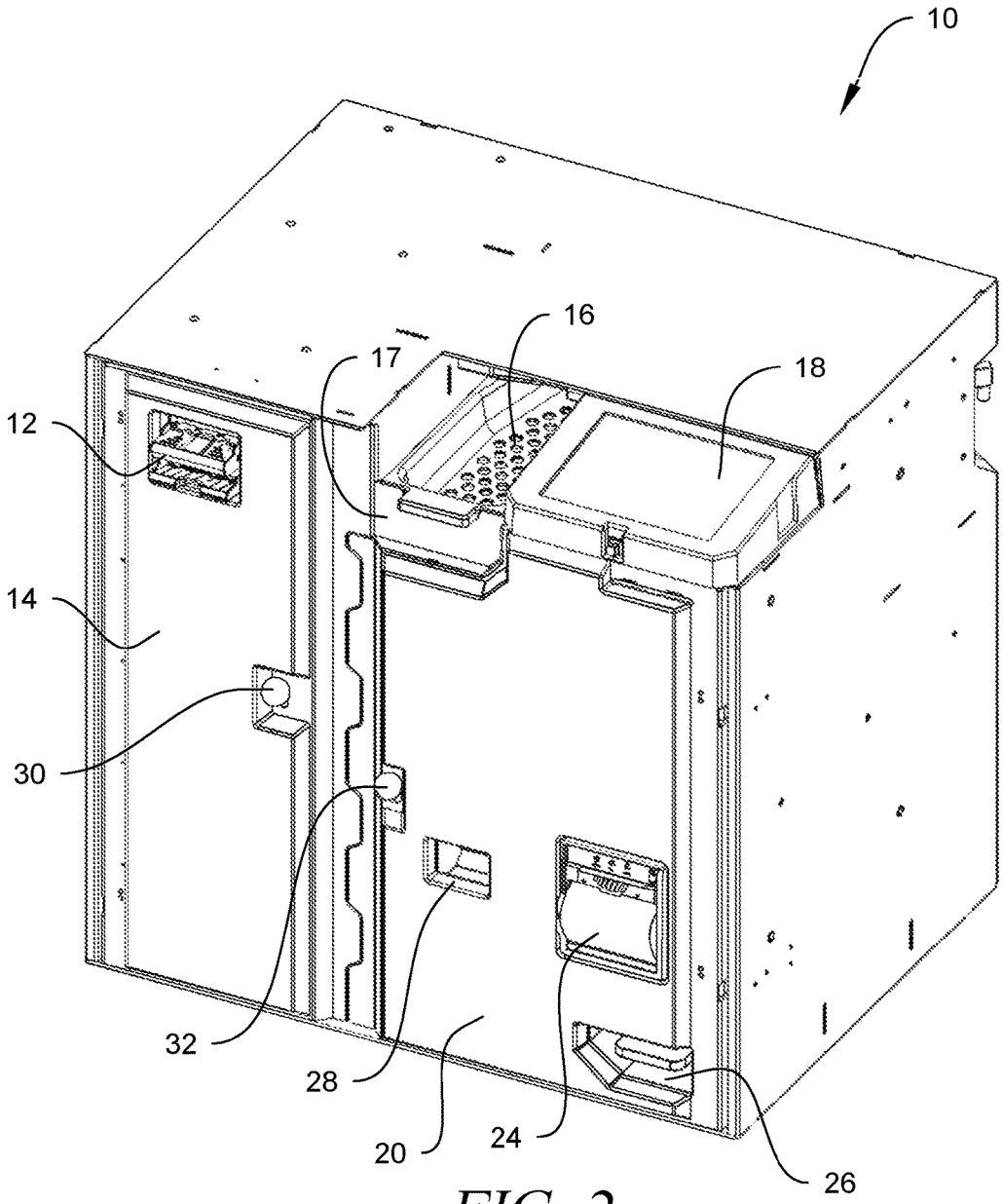
FIG. 2 is a perspective view of the compact currency recycling and accounting device.
Figure 3:
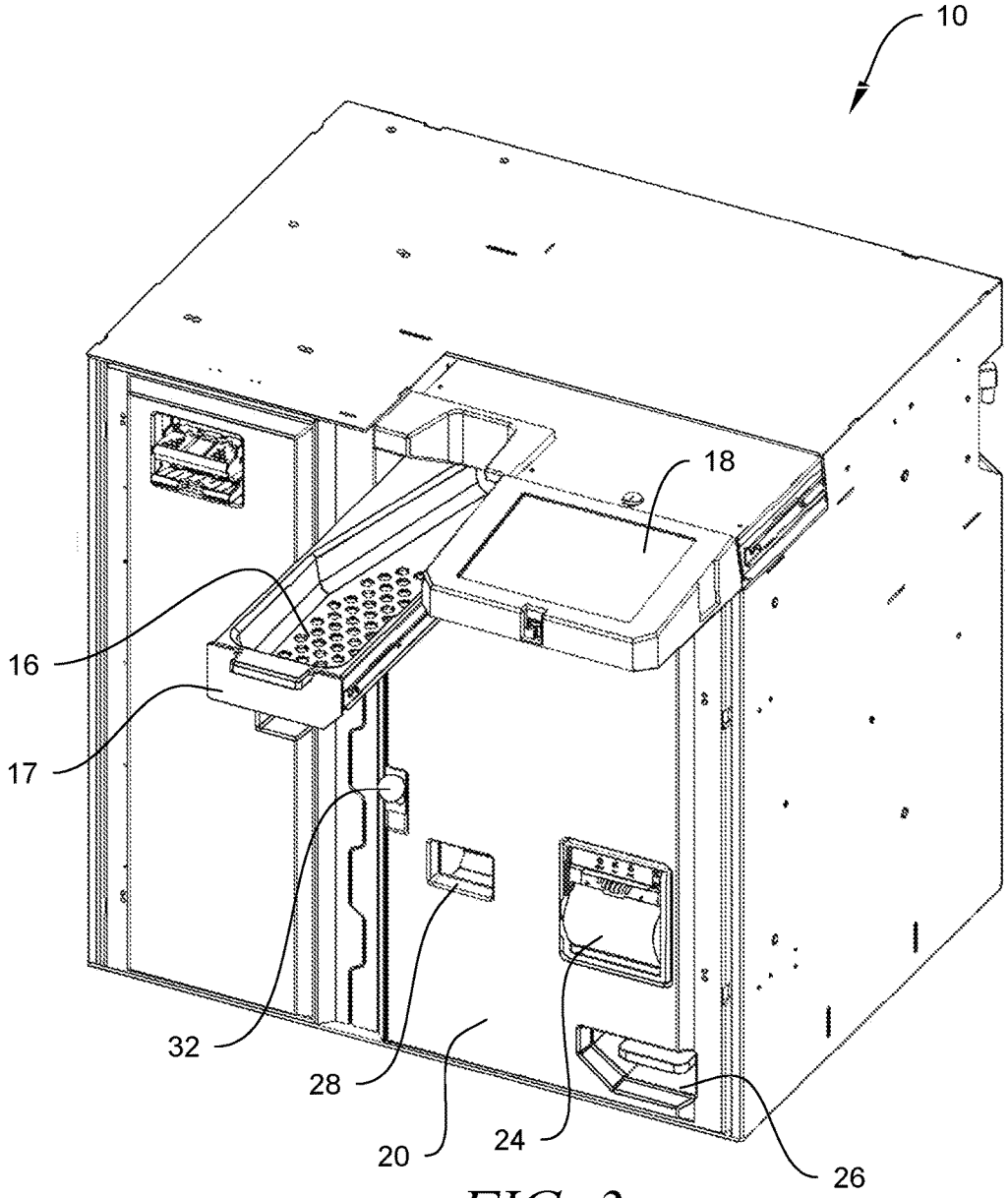
FIG. 3 is a perspective view of the compact currency recycling and accounting device with the coin receiving tray extended for use.
Figure 4:
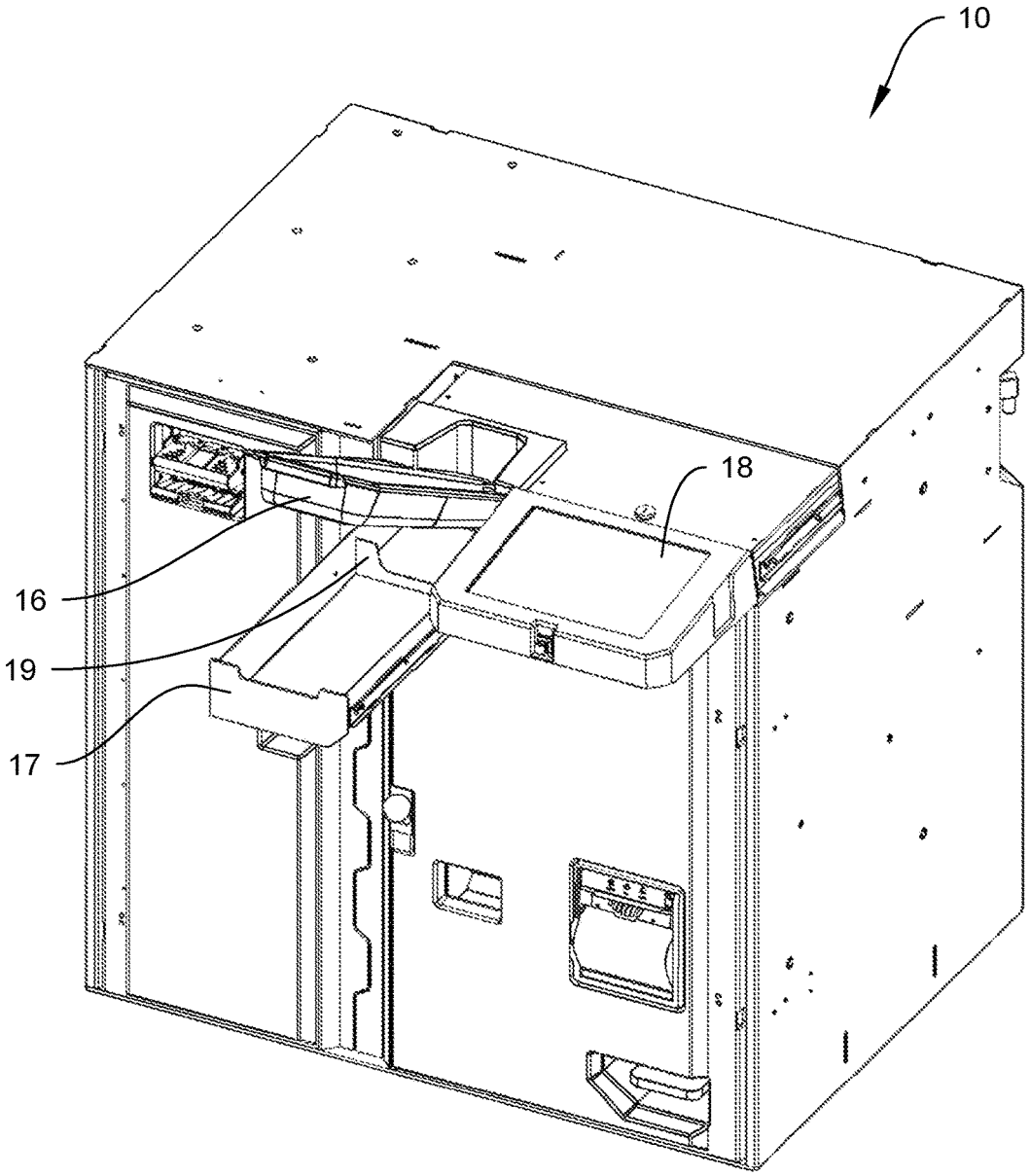
FIG. 4 is a perspective view of the compact currency recycling and accounting device with the perforated portion of the coin receiving tray rotated upward about its hinge.

Referring to FIGS. 2-4, the usage positions of coin receiving tray 17 and touchscreen display 18 of compact currency recycling device 10 are shown. In FIG. 2, coin receiving tray 17 with liftable coin receiving insert 16 is shown in its stored, non-use position where it is tucked into the overall footprint of compact coin recycling device 10. Likewise, touchscreen display 18 is shown in its stored non-use position. In these positions, neither coin receiving tray 17 nor touchscreen display 18 would be accessible from the top to a user because of the countertop (not shown) that would be directly above device 10. In FIG. 3, both coin receiving tray 17 and touchscreen display 18 are shown in their extended, in-use position. In this position, both coin receiving tray 17 and touchscreen display 18 have been slid forward from the front of device 10 and out from underneath the countertop (not shown), which would terminate at or near the front edge of device 10. In this position, a user could easily operate touchscreen display 18 free of encumbrance by the countertop. Likewise, a user could easily load coins into coin receiving insert 16 without being blocked by the countertop. In this position, a user can place coins of mixed denominations into coin receiving insert 16. Insert 16 can include one or more perforations. To load the coins into the coin recycler, coin receiving insert 16 is rotated upwards by a user about its hinge as shown in FIG. 4. In this position, gravity causes the coins to fall into the internal coin sorter receiving bowl discussed below in reference to FIGS. 5 and 7. After the insert 16 and loading the coins into coin sorter, insert 16 can be rotated back downward into coin receiving tray 17 to allow tray 17 to be returned to its original position by sliding tray 17 into device 10.

Because liquid spills can occur in certain environments, such as on countertops, coin receiving tray 17 includes vertical barrier 19, as shown in FIG. 4 located between the front portion and the back portion of tray 17 to prevent unwanted liquid spills that have entered tray 17 through the perforations in coin receiving insert 16 from entering the coin recycler. Vertical barrier 19 extends perpendicularly from tray 17 and fits in a slot of coin receiving insert 16 such that when coin receiving insert 16 is rotated upwards to load the coins, vertical barrier 19 remains in tray 17 and does not interfere with the flow of the coins. Preferably, the front portion of coin receiving tray 17 is slanted downwardly towards the front of device 10, and tray 17 includes a weep hole or other openings in the front portion to allow liquids that have entered tray 17 through the perforations to drain out of tray 17 and not enter device 10.

Coin receiving tray 17 preferably includes features that limit the user's ability to manipulate tray 17 to prevent damage to tray 17 when it is being slid into or out of device 10. One such feature is a restrictor placed at the rear of the back portion of tray 17 that prevents coin receiving insert from being lifted vertically until tray 17 has been pulled out from the front of device 10 a certain distance. The restrictor travels through a path as it is pulled out and travels over the coin receiving bowl. When the restrictor is over the bowl, it can be rotated downwardly into the bowl as the front edge of coin receiving insert 16 is rotated vertically. Coin receiving tray 17 cannot be horizontally returned to the device if coin receiving insert 16 is in the uplifted position because of an additional restrictor located on compact currency recycling device 10.

Figure 5:
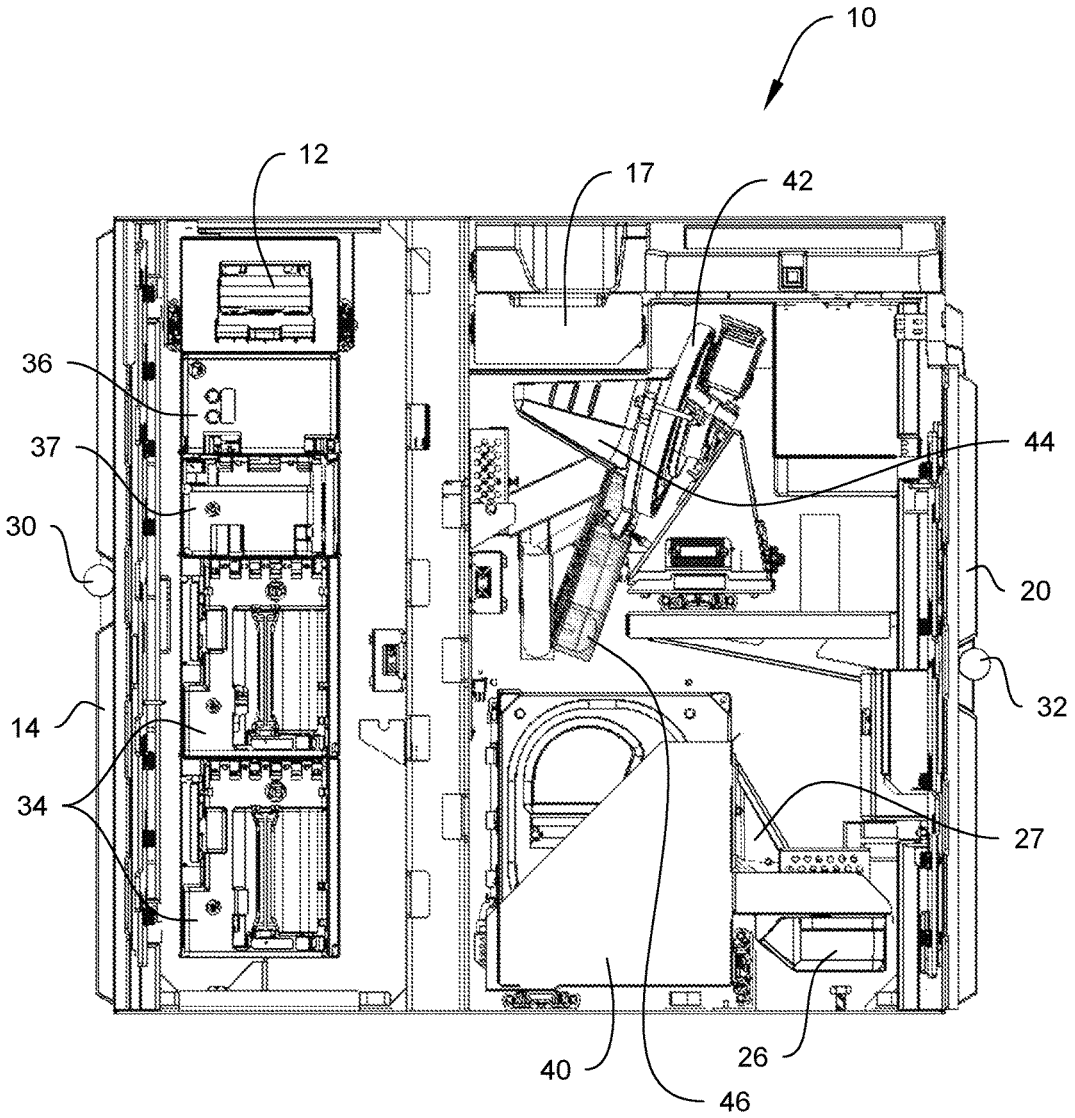
FIG. 5 is a front view of the compact currency recycling and accounting device with the front doors open.

Referring to FIG. 5, a front view of compact currency recycling device 10 is shown with doors 14 and 20 open. On the left side of device 10 is located the banknote recycler. Banknote validator 12 accepts, separates, validates, counts and sorts the banknotes of various denominations before transporting the banknotes to cassettes configured to store the banknotes, which can be either recycling cassette 36 or deposit cassettes 34. On the right side of device 10 is located the coin recycler, which consists generally of coin receiving bowl 44, coin sorter 42, upper coin manifold 45, coin paths 46, coin hoppers 40, lower coin manifold 27 and coin transport tray 26.

Figure 6:
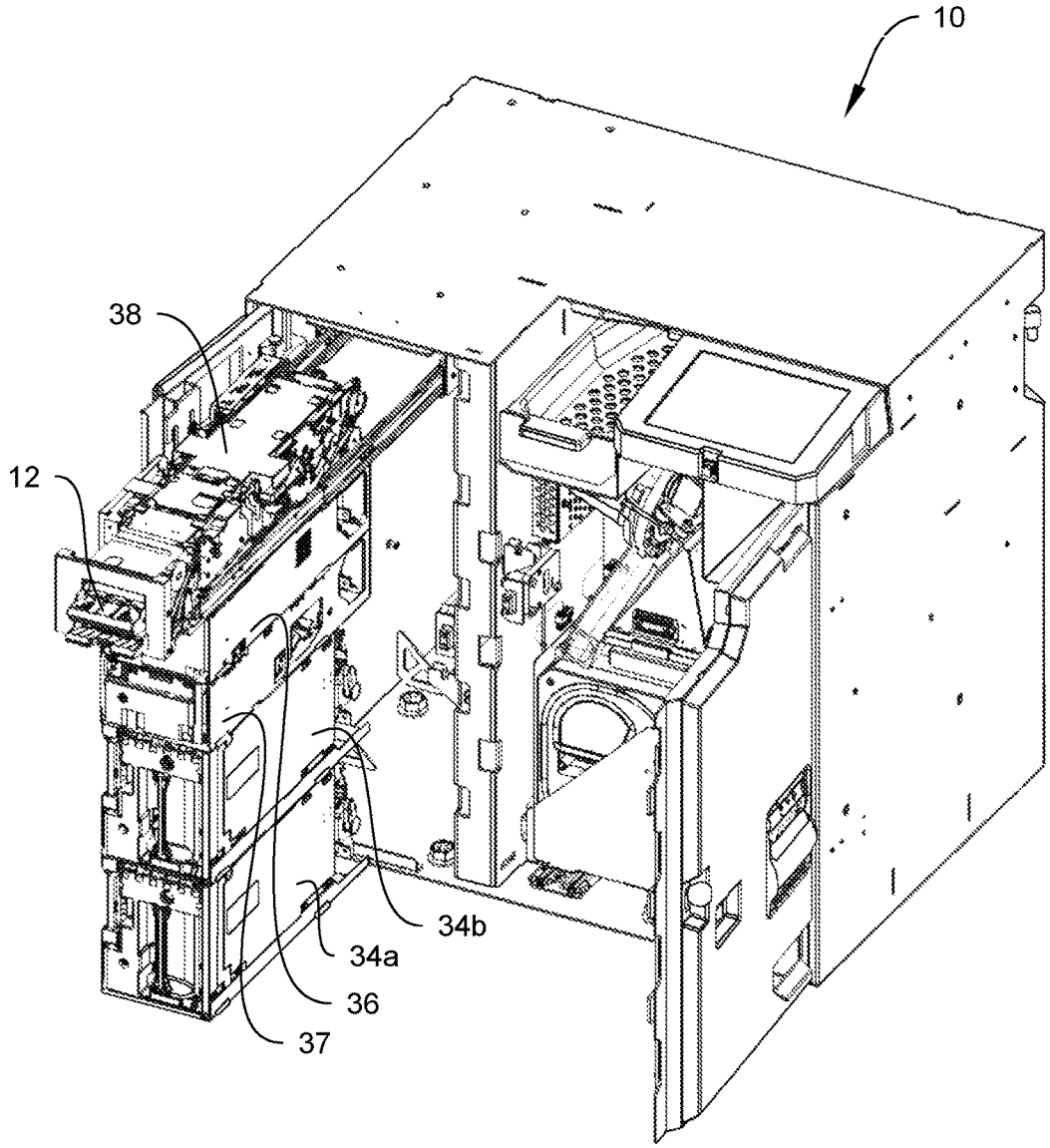
FIG. 6 is a perspective view of the compact currency recycling and accounting device with the front doors open and the banknote recycler slid out for access.

Referring to FIG. 6, the banknote recycler components are shown in a slid forward position out of compact currency recycler device 10. Banknote recycler components would be extended outwardly in this position when the banknote recycler operator or the cash-in-transit courier needs access to the cassettes. The banknote recycler comprises banknote acceptor 12 to accept banknotes of mixed denomination where they then enter top module 38, which is the actual cash receiving and sending mechanism. Top module 38 is capable of separating, validating, counting, sorting and moving the banknotes into cassettes 34*a*, 34*b* and 36, which are configured to store banknotes. The banknote recycler components are slid into device 10 (as shown in FIG. 5) during use in which the cassettes are located under the area of banknote acceptor 12 where the banknotes are separated, validated, counted and sorted.

Recycling cassette 36 preferably contains two drums and is configured to receive banknotes of two specific denominations—one denomination per drum. Typically in this two drum recycling cassette setup, one drum of recycling cassette 36 will store $1 bills and the other drum of recycling cassette 36 will store $5 bills. Alternatively, compact currency recycling device 10 can include a plurality of recyclying cassettes with each being capable of storing up to two denominations. Recycling cassette 36 is capable of dispensing the stored banknotes for re-use by the operator of device 10. Deposit cassettes 34*a* and 34*b* house banknotes of multiple denominations that are either of low-quality or when there is no recycling cassette configured to accept that denomination (e.g., $10, $20 and $100 bills). Additionally, the operator can control the banknote recycler to have recycling cassette 36 dispense banknotes into deposit cassettes 34*a* or 34*b* to reach a desired monetary value for subsequent retrieval by the cash-in-transit courier. Refill cassette 37 is manually filled by the operator and stores banknotes of one denomination that can be transported into recycling cassette 36 in case the operator has already emptied recycling cassettes 36 and needs to dispense additional banknotes.

Figure 7:
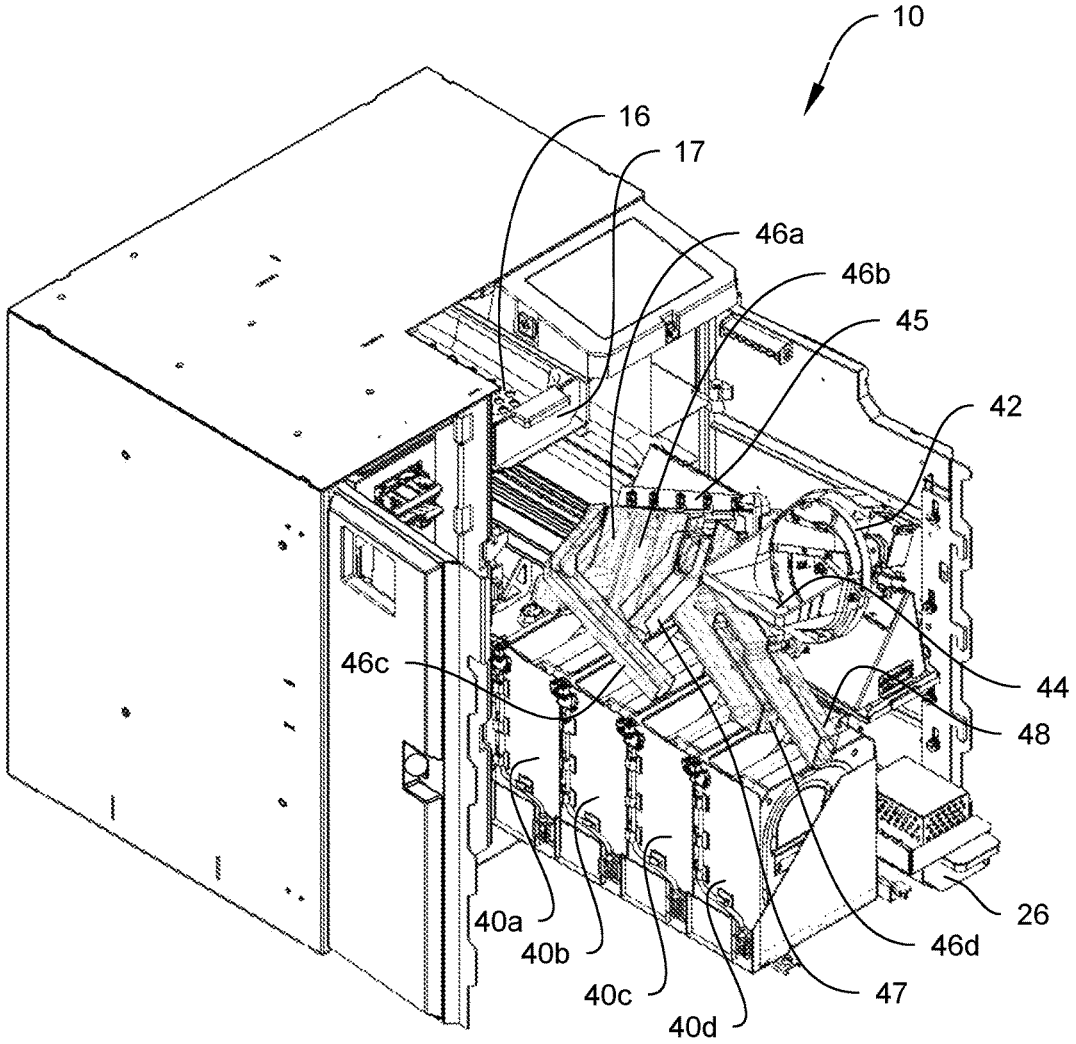
FIG. 7 is a perspective view of the compact currency recycling and accounting device with the coin recycler slid out for access.

Referring to FIG. 7, the coin recycler components are shown in a slid forward position out of compact currency recycler 10. The coin recycler is capable of receiving a batch of mixed denomination coins, sorting the coins into denominations and dispensing a desired amount of coins. The batch of mixed denomination coins is received by the coin recycler through coin receiving tray 17 and coin receiving insert 16 as discussed above in reference to FIGS. 2-4. Once the coins are dumped out of coin receiving insert as shown in FIG. 4, the coins fall into coin receiving bowl 44 shown in FIG. 5.

Coin receiving bowl 44 is angled downward so that coins are gravity-fed into coin sorter 42. Coin sorter 42 sorts the coins by denomination, which then pass into a first manifold consisting of individual coin paths 46*a*-46*d* for each coin denomination shown in FIG. 7. The first manifold is connected directly to coin sorter 42 as opposed to the base of coin sorter 42 to make more efficient use of the limited amount of vertical distance available in an under the counter compact safe. The coins travel through the individual coin paths 46*a*-46*d* into separate coin hoppers 40*a*-40*d* for each coin denomination, where they are stored. Additionally, coin chute 47 transports dollar coins to a separate hopper (not shown), which is not part of the coin recycling operation. If any dollar coins are encountered by coin sorter 42, they are transported through coin chute 47 to this non-shown hopper, where they remain until an operator or cash-in-transit courier opens device 10. Preferably the manifold 45 and coin paths 46*a*-46*d* are made from a clear material so as to afford visible inspection during maintenance, which will afford a maintenance technician any easy way to identify any manifold or coin path blockages.

If coin sorter 42 encounters an item or debris that is not a valid coin of one of the denominations device 10 is set to recycle, the item or debris is deposited in chute 48, which is connected to coin reject slot 28 located in door 20 (shown in FIG. 1). Preferably, coin sorter 42 incorporates coin discrimination technology for rejecting any counterfeit coins loaded into coin sorter 42. After the coins are sorted and stored in coin hoppers 40*a*-40*d*, they are dispensed into lower manifold 27, which consists of individual coin paths that terminate above coin transport tray 26. Lower manifold coin paths can be spaced appropriately such that the dispensed coins will fall directly into the appropriate compartments of coin transport tray 26.

Figure 8:
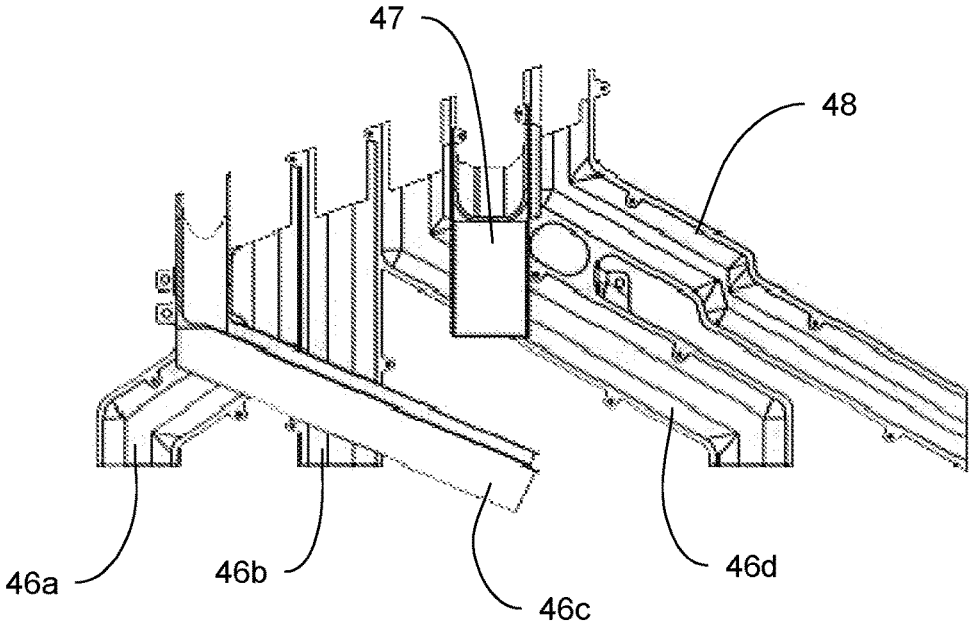
FIG. 8 is a side view of the upper coin paths for the compact currency recycling and accounting device.

Referring to FIGS. 7 and 8 and because compact currency recycling device 10 is sized to fit under countertops, there is less vertical drop for the coins to travel between entry into the upper portion of device 10 via coin receiving tray 17 and exit from device 10 via coin transport tray 26. In order to facilitate coin sorting within a limited amount of vertical drop, the coin travel paths through the entire coin recycler are slanted or angular rather than strictly vertical, which reduces the vertical space required. For example, coin path 46*c* begins at the lowest point of manifold 45 furthest away from coin sorter 42, drops sharply down outwardly from manifold 45 and then is sharply angled back and down towards the front of device 10 where it terminates above coin hopper 40*c*. Likewise coin path 46*d* take a similar angle towards the front of device 10 and downward after steeply falling away from manifold 45 before terminating above coin hopper 40*d*. Coin path 46*a* drops sharply down from manifold 45 and then is sharply angled back and down towards the back of device 10 where it terminates above coin hopper 40*a*. Coin path 46*b* drops sharply down from manifold 45 in a straight line which places its termination point directly above coin hopper 40*b*.

A user of compact currency recycling device 10 interfaces with device 10 through touchscreen display 18. In the preferred embodiment, each user would enter a unique user-identification PIN code on touchscreen display 18, which would allow device 10 to account for each user's activity with device 10 including counting the amount of currency, both banknotes and coins, that have been inserted into device 10 by that particular user or dispensed from device 10 to that particular user. Alternatively, device 10 may have integrated biometric technology to allow for the use of a user's fingerprints for example. After the user enters the PIN, the user can select to deposit banknotes into device 10. The user would be prompted to feed the banknotes into banknote validator 12, and device 10 would display to user via touchscreen display 18 the amount of banknotes deposited and record that amount. Device 10 also offers configurable user permission levels for device access wherein certain users (e.g., store employees) can perform limited tasks (e.g., deposit banknotes or coins) compared to more senior-level users that can perform additional tasks (e.g., withdraw banknotes or coins).

Compact currency recycling device 10 can be set to monitor each employee, or alternatively a specific cash drawer till used by multiple employees during a shift. Device 10 therefore affords increased functionality, individual accountability and speed of processing. Device 10 also eliminates the time and effort required to manually count coins and bill notes. The automated accounting increases operator and manager accountability and can reduce losses. Further, device 10 has reporting capabilities to both banks and cash-in-transit couriers. Device 10 also preferably runs automatic end of day reporting while also providing real time banknote and coin level monitoring capabilities.

Device 10 can be networked with other similar devices in use throughout the store or at a remote gas kiosk for example to allow total net reporting and provide complete store accounting and visibility. Device 10 can be networked with a bank or financial institution to offer provisional credit to the operator of device 10 when currency is deposited into deposit cassettes 34*a* or 34*b*.

Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

The invention claimed is:

1. A compact currency recycling device comprising:

a housing suitable for placement under a counter;

a coin recycler including a coin input tray in the front of said housing for receiving coins located on the exterior of said housing; a coin sorter disposed in said housing for sorting the coins into different denominations, and a plurality of coin hoppers disposed in said housing for storing the coins of sorted denominations and operable to dispense coins stored therein;

a banknote recycler including a banknote acceptor accessible via the front of said housing for accepting banknotes of mixed denomination, and at least one cassette for storing the banknotes and operable to dispense banknotes stored therein;

a user input device allowing a user to input operational commands for the device;

wherein the coin input tray extends outwardly from the front of the device to allow accessibility when in use.

2. The compact currency recycling device of claim 1 wherein the user input device extends outwardly from the front of the device to allow accessibility when in use.

3. The compact currency recycling device of claim 1 further comprising a coin transport tray accessible via the exterior of said housing wherein the coin transport tray receives the coins dispensed from said coin hoppers.

4. The compact currency recycling device of claim 1 wherein the banknote acceptor validates the accepted banknotes.

5. The compact currency recycling device of claim 1 wherein the banknote acceptor counts the accepted banknotes.

6. The compact currency recycling device of claim 1 wherein the banknote acceptor sorts the accepted banknotes.

7. The compact currency recycling device of claim 1 wherein the housing is accessible via at least one front-opening door.

8. The compact currency recycling device of claim 1 wherein the user input device is integrated in the device.

9. The compact currency recycling device of claim 1 wherein the user input device is a touchscreen display.

10. The compact currency recycling device of claim 1 further comprising an integrated printer.

11. The compact currency recycling device of claim 1, wherein the user input device extends outwardly from the front of the device independently from the coin input tray.

12. A compact currency recycling and accounting device comprising:

a housing suitable for placement under a counter;

a coin recycler including a coin input tray in the front of said housing for receiving coins located on the exterior of said housing; a coin sorter disposed in said housing for sorting the coins into different denominations, and a plurality of coin hoppers disposed in said housing for storing the coins of sorted denominations and operable to dispense coins stored therein;

a banknote recycler including a banknote acceptor accessible via the front of said housing for accepting banknotes of mixed denomination, and at least one cassette for storing the banknotes and operable to dispense banknotes stored therein;

a user input device allowing a user to input operational commands for the device;

a CPU and software capable of controlling the coin recycler and banknote recycler pursuant to the operational commands received via the user input device; and a power supply;

wherein the coin input tray extends outwardly from the front of the device to allow accessibility when in use.

13. The compact currency recycling and accounting device of claim 12, wherein the user input device extends outwardly from the front of the device independently from the coin input tray.

14. A method of using a coin recycler housed in a compact currency recycling device comprising the steps of:

accessing a user input device to input operational commands for the device;

extending a coin input tray having a coin receiving insert outwardly from the front of the device to allow the loading of a plurality of coins into said insert;

transporting the coins from said insert into a coin sorter by lifting up said insert wherein the coin sorter sorts the coins into various denominations;

transporting the sorted coins to a plurality of coin hoppers for storing the coins of sorted denominations, which are operable to dispense the coins stored therein.

15. The method of using a coin recycler housed in a compact currency recycling device of claim 14, further comprising the step of returning the coin receiving insert to said tray and sliding said tray into the front of the device.

16. The method of using a coin recycler housed in a compact currency recycling device of claim 14, further comprising the step of extending the user input device outwardly from the front of the device before inputting operational commands.

* * * * *